US009447487B2

(12) United States Patent
Kim et al.

(10) Patent No.: US 9,447,487 B2
(45) Date of Patent: Sep. 20, 2016

(54) TORSIONAL EXTREME-PLASTIC PROCESSING METHOD OF CONIC METAL PIPE

(71) Applicant: POSTECH ACADEMY-INDUSTRY FOUNDATION, Gyeongsangbuk-do (KR)

(72) Inventors: Hyoung-Seop Kim, Gyeongsangbuk-do (KR); Ho-Yong Um, Gyeongsangbuk-do (KR); Eun-Yoo Yoon, Daejeon (KR); Dong-Jun Lee, Daejeon (KR); Seong Lee, Daejeon (KR)

(73) Assignee: POSTECH ACADEMY-INDUSTRY FOUNDATION, Pohang-Si, Gyeongsangbuk-Do (KR)

( * ) Notice: Subject to any disclaimer, the term of this patent is extended or adjusted under 35 U.S.C. 154(b) by 172 days.

(21) Appl. No.: 14/365,837

(22) PCT Filed: Nov. 30, 2012

(86) PCT No.: PCT/KR2012/010335
§ 371 (c)(1),
(2) Date: Jun. 16, 2014

(87) PCT Pub. No.: WO2013/089374
PCT Pub. Date: Jun. 20, 2013

(65) Prior Publication Data

US 2014/0331733 A1 Nov. 13, 2014

(30) Foreign Application Priority Data

Dec. 16, 2011 (KR) ..... 10-2011-0136224

(51) Int. Cl.
*C22F 1/00* (2006.01)
*B21D 11/14* (2006.01)
(Continued)

(52) U.S. Cl.
CPC ..... *C22F 1/00* (2013.01); *B21C 23/01* (2013.01); *B21D 22/022* (2013.01);
(Continued)

(58) Field of Classification Search
CPC .... B21D 11/14; B21D 22/02; B21D 22/022; B21D 22/025; B21D 35/002; B21D 37/16; B21D 51/10; B21C 23/00; B21C 23/001; B21C 23/01; B21C 23/18; B21C 23/183; B21C 23/186; B21C 25/02; B21C 29/04; B21C 37/065; B21C 37/15; B21C 37/16; B21C 37/18; B21J 1/02; B21J 1/025; B21J 1/04; B21J 1/06; B21J 5/02; B21J 5/025; B21J 5/063; B21J 9/025; B21K 21/02; B21K 21/04; B21K 21/06; B21K 21/08; B21K 21/10; C21D 7/02; C21D 7/13; C21D 9/0068; C21D 9/10; C22F 1/00
USPC ..... 72/68–69, 112, 115, 342.1, 342.7, 72/342.8, 342.9, 267, 352, 356, 358, 359, 72/364, 370.02, 370.14, 377
See application file for complete search history.

(56) References Cited

U.S. PATENT DOCUMENTS 3,839,890 A * 10/1974 Phlippoteau ..... B21C 23/20 72/256
5,737,959 A * 4/1998 Korbel ..... B21B 1/166 72/256

(Continued)

FOREIGN PATENT DOCUMENTS

CN 102189706 A 9/2011
JP 2005-000990 A 1/2005
KR 10-2005-0073129 A 7/2005

OTHER PUBLICATIONS

International Search Report for PCT/KR2012/010335.

(Continued)

*Primary Examiner* — Peter DungBa Vo
*Assistant Examiner* — Joshua D Anderson
(74) *Attorney, Agent, or Firm* — Revolution IP, PLLC

(57) ABSTRACT

The present invention relates to a torsional extreme-plastic processing method. In other words, a processing method in which severe plastic deformation based on torsion and compressive force is applied to a material by using a mold to produce miniaturize and nano-size crystal particles in a conic pipe. According to the severe plastic deformation method of the present invention, a punch that matches an inner shape of the conic metal pipe is mounted inside the conic metal pipe, and then a mold that matches an outer shape of the conic metal pipe is mounted outside the conic metal pipe. Thus, microstructures of the conic metal pipe may be ultra-finely crystallized or nano-crystallized through shearing by applying compression and torsion to the conic metal pipe.

17 Claims, 3 Drawing Sheets

(51) Int. Cl.

| | |
|---|---|
| ***B21D 22/02*** | (2006.01) |
| ***B21D 35/00*** | (2006.01) |
| ***C21D 7/02*** | (2006.01) |
| ***B21D 51/10*** | (2006.01) |
| ***C21D 9/00*** | (2006.01) |
| ***C21D 9/10*** | (2006.01) |
| ***B21C 23/01*** | (2006.01) |
| ***B21K 21/02*** | (2006.01) |
| ***B21J 1/02*** | (2006.01) |
| *B21C 37/18* | (2006.01) |
| *B21J 5/06* | (2006.01) |

(52) U.S. Cl.

CPC ..... *B21D 35/002* (2013.01); *B21D 51/10* (2013.01); *B21J 1/025* (2013.01); *B21K 21/02* (2013.01); *C21D 7/02* (2013.01); *C21D 9/0068* (2013.01); *C21D 9/10* (2013.01); *B21C 37/18* (2013.01); *B21D 11/14* (2013.01); *B21J 5/063* (2013.01)

(56) References Cited

U.S. PATENT DOCUMENTS

| | | | | |
|---|---|---|---|---|
| 6,866,180 | B2 * | 3/2005 | Mahoney | B21D 5/02 148/564 |
| 7,096,705 | B2 * | 8/2006 | Segal | B21C 23/01 72/253.1 |
| 2012/0324976 | A1 * | 12/2012 | Long | B21J 1/06 72/342.7 |

OTHER PUBLICATIONS

European Search Report for EP Application No. 12 856 595.9 mailed Sep. 23, 2015 from European Patent Office.

Rimma Lapovok et al, "Severe Plastic Deformation Processes with Friction Induced Shear", Materials Science Forum, vol. 667, Dec. 30, 2010, pp. 25-30.

Lapovok R et al., "Severe plastic deformation processes for thin samples", Journal of Materials Science, Kluwer academic publishers, Bo, vol. 45, No. 17, Mar. 27, 2010, pp. 4554-4560.

Lapovok R et al., "The effect of grain refinement by warm equal channel angular extrusion on room temperature twinning in magnesium alloy ZK60", Journal of Materials Science, Kluwer academic publishers, Bo, vol. 40, No. 7, Apr. 1, 2005, pp. 1699-1708.

* cited by examiner

FIG. 4(A)
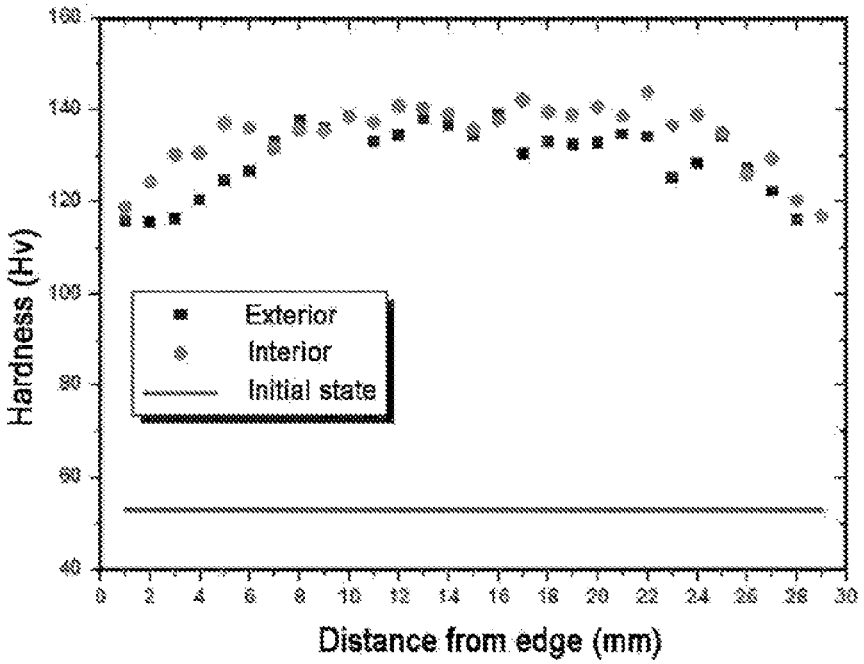
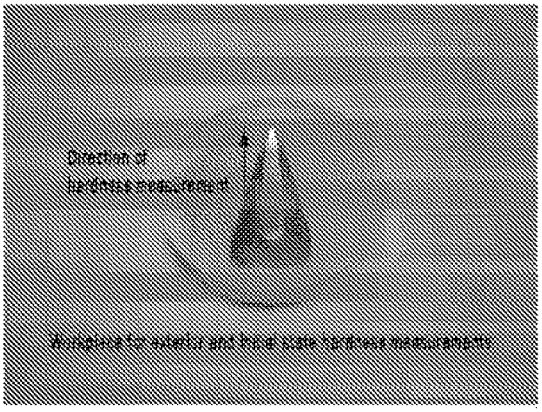
FIG. 4(B)
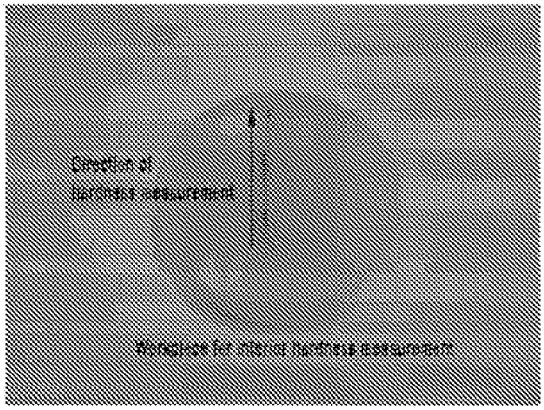
FIG. 4(C)

TORSIONAL EXTREME-PLASTIC PROCESSING METHOD OF CONIC METAL PIPE

CROSS REFERENCE TO RELATED APPLICATIONS AND CLAIM OF PRIORITY

This patent application is a National Phase application under 35 U.S.C. §371 of International Application No. PCT/KR2012/010335, filed 30 Nov. 2012, which claims priority to Korean Patent Application No. 10-2011-0136224, filed 16 Dec. 2011, entire contents of which are incorporated herein by reference.

TECHNICAL FIELD

The present invention relates a method of performing a strong torsional plastic forming process to a conic metal pipe, and more particularly to a method of performing a strong torsional plastic forming process to a conic metal pipe, which provides the conic metal pipe with a shear deformation caused by shear stress resulting from application of a compressive force and a twisting force while substantially maintaining a shape of the conic metal pipe, thereby causing a fine microstructure of the conic metal pipe to have ultrafine crystal grains or nanocrystalline grains and thus improving mechanical properties of the conic metal pipe.

BACKGROUND ART

A conic metal pipe is used in various industrial fields such as fields of manufacturing head parts of bullets or missiles, components of vehicles such as aircraft and automobiles, kitchen instruments and heating instruments. Such a conic metal pipe has been conventionally worked into a predetermined configuration through a "Metal spinning" technique.

However, because the "Metal spinning" technique is a metallic working process which is chiefly intended to control configurations of workpieces, it has little relevance to improvement of mechanical properties such as control of fine microstructure. Furthermore, according to the "Metal spinning" technique, because deformation caused by high pressure applied from a metal tool is concentrated to a surface of a metal pipe workpiece, there is a problem in that a great difference between mechanical properties of internal and exterior areas of the worked metal pipe occurs.

A metal material begins to form dislocation cells having small boundary angles when it is subjected to plastic deformation, and crystal grain boundary angles of sub-grains increase and crystal grains increasingly become fine as the amount of plastic deformation increases. Therefore, when metal material is highly deformed and thus crystal grains thereof become ultrafine grains or nanocrystalline grains, the deformed metal material has considerably improved mechanical properties (yield strength, tensile strength, hardness, wear resistance, superplasticity and the like) compared to a metal material which is not deformed. Accordingly, there is a need for a working process for producing a metal material having ultrafine crystal grains/nanocrystalline grains, rather than a conventional working process which is designed to mainly change a shape of the metal material.

The formation of ultrafine crystal grains/nanocrystalline grains is affected by an amount of plastic deformation such as compressive deformation, tensile deformation and shear deformation which a workpiece undergoes. In addition, it is critical to design a metal die which maintains the substantially same shape before and after being subjected to a forming process, such that even when a workpiece undergoes a large amount of deformation the die maintains its shape, so as to allow the execution of repeated processes.

Working processes, which meet the above requirements and have been developed to date, may include Equal Channel Angular pressing (ECAP), High-Pressure Torsion (HPT), Accumulative roll Bonding (ARB), Equal Channel Angular Rolling (ECAR) and the like.

However, a working process which can give a severe plastic deformation to conic metal pipe in accordance with a configuration of the conic metal pipe, has not yet been developed, and thus there is a need for development of this kind of working process.

SUMMARY

Accordingly, an object of the present invention is to provide a method of performing a severe plastic deformation process to a conic metal pipe, which can substantially maintain a shape of the conic metal pipe to allow the conic metal pipe to be subjected to a large deforming process and which can cause a fine microstructure of the conic metal pipe to have ultrafine crystal grains or nanocrystalline grains to substantially improve mechanical properties of the conic metal pipe.

In order to accomplish the above object, the present invention provides a method of performing a strong torsional plastic forming process to a conic metal pipe, including: mounting a punch having a configuration corresponding to an interior configuration of the conic metal pipe in the conic metal pipe; mounting a metal die having a configuration corresponding to an exterior configuration of the conic metal pipe on the conic metal pipe; and concurrently applying compressive and twisting forces to the conic metal pipe through the punch and the metal die to cause shear deformation of the conic metal pipe, thus enabling a fine microstructure of the conic metal pipe to have ultrafine crystal grains or nanocrystalline grains.

In an aspect of the present invention, the shear deformation may be obtained by pressing the punch against the metal die and rotating the punch. In contrast, the twisting force may be applied by rotating the metal die while pushing the metal die or rotating the punch and the metal die in directions opposite to each other (for example, rotating the punch in a clockwise direction while rotating the metal die in a counterclockwise direction).

In an aspect of the present invention, an amount of the shear deformation may be controlled by adjustment of a compressive force and a number of revolutions of the punch. When the punch and the metal die are concurrently rotated, the amount of the shear deformation may be controlled by adjustment of the metal die alone or both the punch and the metal die.

In an aspect of the present invention, a higher compressive force may be applied to a central area of the conic metal pipe so as to cause the fine microstructure of the central area to have ultrafine crystal grains or nanocrystalline grains.

In an aspect of the present invention, it is preferred that shape of the conic metal pipe which is not subjected to the strong torsional plastic forming process is substantially equal to a shape of the conic metal pipe which is subjected to the strong torsional plastic forming process. Consequently, repeated deformation can be applied to the conic metal pipe using the same punch and metal die, and thus a large amount of deformation can be applied.

In an aspect of the present invention, one or both of the metal die and the punch may include a heating element to control a process temperature. Consequently, the conic metal pipe can be worked at an appropriate process temperature according to material of the metal pipe, and thus fine microstructure of the metal pipe can be controlled thus improving efficiency of process. Alternatively, the heating element may be provided outside rather than in the metal die or the punch.

In an aspect of the present invention, a radius of curvature of a tip of the punch may be larger than that of a tip of the workpiece. Consequently, a thickness of the conic metal pipe can be evenly maintained along a height direction thereof, and thus concentration of stress can be prevented thereby preventing breakage of the conic metal pipe.

According to the method of the present invention, maintenance of the conical shape enables a conic metal pipe to be subjected to great shear and compressive deformation without loss of material, thus causing a fine microstructure of the conic metal pipe to have ultrafine crystal grains or nanocrystalline grains. Consequently, mechanical properties of the conic metal pipe are remarkably increased, thus providing the conic metal pipe satisfying various mechanical property requirements.

Furthermore, since the method of the present invention enables the conical shape of the conic metal pipe to be consistently maintained before and after the plastic forming process, torsional deformation and mechanical properties can be controlled through the repeated process.

Furthermore, according to the method of the present invention, an amount of deformation of a workpiece can be freely controlled by adjusting the number of revolution of the punch (or metal die) during to process, and it is thus easy to control mechanical properties and a fine microstructure of the conic metal pipe.

DESCRIPTION OF DRAWINGS

FIG. 4(A) shows results obtained from a hardness test which is performed before and after being subjected to the severe plastic deformation process according to the embodiment of the present invention, FIGS. 4(B) and (C) show directions of the hardness measurement.

DETAILED DESCRIPTION

Figure 1:
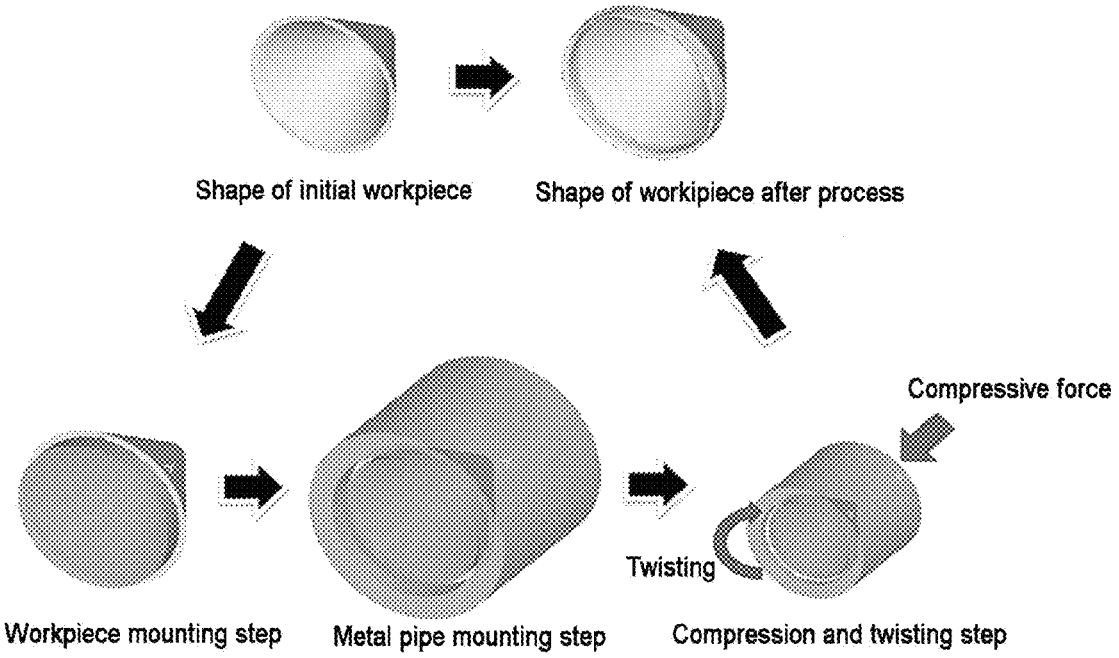
FIG. 1 schematically illustrates a punch and a metal die used in a severe plastic deformation process according to the present invention and process steps thereof.
Figure 2:
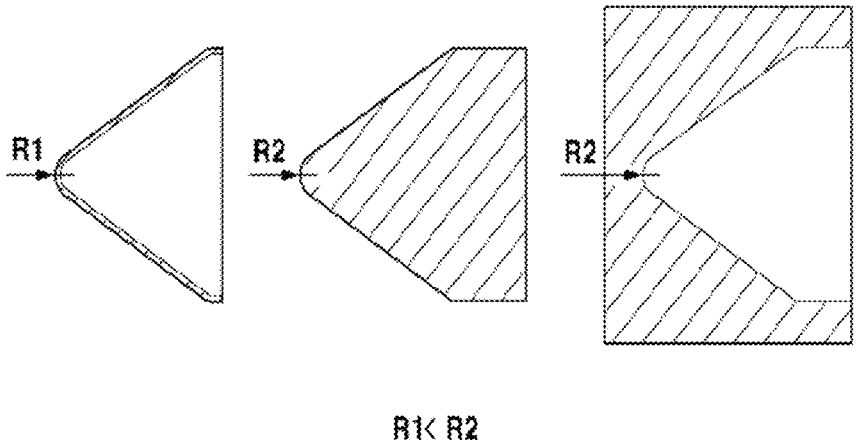
FIG. 2 is a cross-sectional view of the metal die, the punch and a workpiece used in an example of the present invention.

FIG. 1 schematically illustrates a punch and a metal die used in a severe plastic deformation process according to the present invention and process steps thereof, FIG. 2 is a cross-sectional view of the metal die, the punch and a workpiece used in an example of the present invention, FIG. 3(A) is a photograph showing a conic metal pipe which has not been subjected to a severe plastic deformation process, and FIG. 3(B) is a photograph showing the conic metal pipe which has been subjected to the severe plastic deformation process.

The manufacturing process according to the present invention will now be specifically described with reference to the accompanying drawings. The severe plastic deformation process according to the present invention may include, as a whole, mounting a conic metal pipe workpiece on a punch and a metal die (first step), pressing the workpiece using the punch and the metal die (second step), and giving a twisting action to the conic metal pipe workpiece (third step).

As illustrated in FIGS. 1 and 2, the first step for mounting the conic metal pipe workpiece on the punch and the metal die is performed in such a way that the punch which is prepared to have a configuration corresponding to the internal configuration of the conic metal pipe workpiece is mounted in the conic metal pipe workpiece and then the conic metal pipe workpiece with the punch mounted therein is mounted in the metal die which is prepared to have a configuration corresponding to the external configuration of the conic metal pipe. In this context, the sequence of mounting the punch and the metal die may be changed depending on the design conditions of the metal die. In other words, the punch may be disposed in the conic metal pipe workpiece after the conic metal pipe workpiece is mounted in the metal die. Furthermore, the metal die may include therein an electric heating element so as to provide heat to the conic metal pipe workpiece according to processing conditions of the conic metal pipe workpiece.

The second step is performed in such a way that a predetermined compressive force is applied to the conic metal pipe workpiece mounted in the metal die by pressing the punch mounted in the workpiece. At this point, the compressive force may be determined depending on the final thickness of the workpiece such that there is no occurrence of slip of the workpiece. The manner of applying the compressive force to the conic metal pipe workpiece may include moving the metal die while holding the punch or moving both the metal die and the punch in addition to moving the punch as described above.

The third step is performed in such a way that the punch is rotated to give a twisting action to the conic metal pipe workpiece while applying a constant compressive force to the conic metal pipe workpiece. After the twisting procedure is completed, the compressive force applied to the workpiece is released and then the workpiece is removed from the metal die.

According to the severe plastic deformation process of the present invention, a twisting force can be applied to the conic metal pipe workpiece while a frictional force occurring at the boundary surface between the conic metal pipe and the punch is considerably increased by applying a hydrostatic pressure to the workpiece, thereby causing the conic metal pipe to be efficiently subjected to a shear deformation without a slip phenomenon. Furthermore, the applied hydrostatic pressure and the shear deformation cause the fine microstructure of the conic metal pipe to have ultrafine crystal grains or nanocrystalline grains.

In the severe plastic deformation process according to the present invention, the fine microstructure and mechanical properties of the conic metal pipe workpiece can be modified to have the desired conditions by controlling the compressive force applied to the conic metal pipe workpiece and the number of rotations of the punch.

The present invention will now be described in detail with reference to a preferred embodiment thereof.

FIG. 2 is a cross-sectional view of the conic metal pipe workpiece, the metal die and the punch used in the embodiment of the present invention. A size and a material of the workpiece may be changed depending on the intended use, and the metal die and the punch are manufactured in accordance with the configuration of the workpiece.

In this embodiment of the present invention, the tip of the punch has a predetermined radius of curvature such that the tip of the punch is less sharp than that of the tip of the workpiece (in other words, a radius of curvature of the tip of the punch is larger than that the tip of the workpiece). This is intended to prevent breakage of the tip region of the workpiece caused by concentration of stress at the tip region during the severe plastic deformation process.

In the severe plastic deformation process according to this embodiment of the present invention, the workpiece was manufactured from pure copper to have the configuration as shown in FIG. 2, subjected to a heat treatment at 600° C. for 2 hours and then slowly cooled in a heating furnace. The severe plastic deformation process was performed at room temperature in such a way that the punch was rotated one revolution at 1 rpm of revolution speed while applying 80 ton of pressure to the punch.

Figure 3:
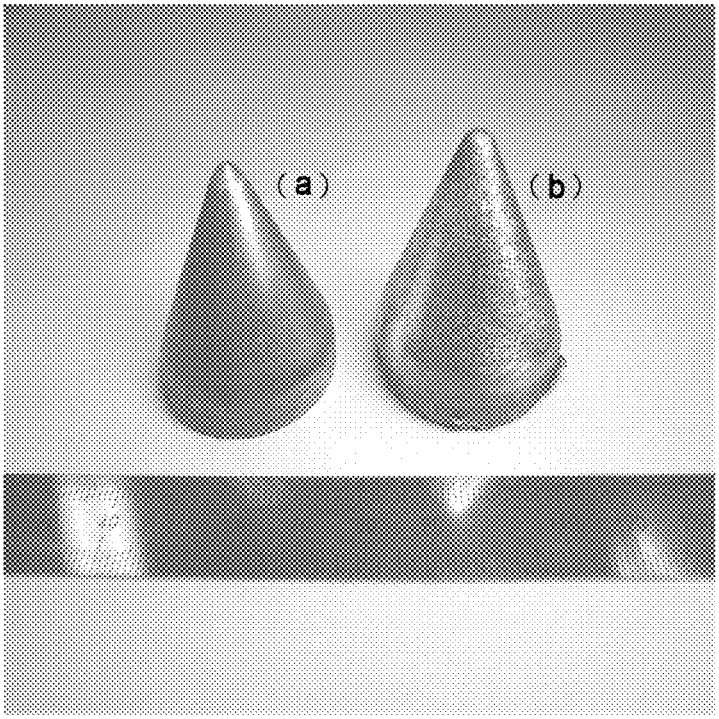
FIG. 3(A) is a photograph showing a conic metal pipe which is not subjected to a severe plastic deformation process.
FIG. 3(B) is a photograph showing the conic metal pipe which has been subjected to the severe plastic deformation process.

FIG. 3 is a photograph showing two workpieces before and after being subjected to the severe plastic deformation process according to the embodiment of the present invention, in which FIG. 3(A) shows the workpiece which has not been subjected to the severe plastic deformation process and FIG. 3(B) shows the workpiece which has been subjected to the process. It is appreciated from the photograph that both the two workpieces before and after being subjected to the severe plastic deformation process are substantially identical to each other in configuration with the exception that a thickness of the workpiece is decreased from 1.2 mm to 0.96 mm due to the effect of the strong compressive force after the severe plastic deformation process. The thickness of the workpiece after being subjected to the severe plastic deformation process may be controlled by selection of the compressive force and the revolution speed of the punch.

FIG. 4(A) shows results obtained from a hardness test which is performed for the purpose of ascertaining the variation of mechanical properties of the workpiece measured before and after being subjected to the severe plastic deformation process according to the embodiment of the present invention.

In the drawing, the term "initial state" refers to a hardness value measured from the edge of the exterior surface toward the central axis of an initial workpiece which has been subjected to heat treatment, the term "exterior" refers to a hardness value measured in the same manner as that in the "initial state" with respect to the workpiece which has been subjected to the severe plastic deformation process, as shown in FIG. 4(A), and the term "interior" refers to a hardness measured on a cross section of the workpiece which has been subjected to the severe plastic deformation process, as shown in FIG. 4(B). In this respect, directions of the hardness measurement are as illustrated in FIGS. 4(A) and 4(B), and the interval between measurement points is 1 mm.

As seen from FIG. 4, a hardness value of a workpiece which had been subjected to the severe plastic deformation process was considerably increased to higher than 53 of the average hardness value (Hv) of the workpiece in its initial state, and more specifically a maximum hardness of the workpiece, which had been subjected to the severe plastic deformation process one time, was increased to 140 Hv. It is appreciated that the workpiece was evenly hardened throughout its entirety as proven from the fact that there was no perceptible difference between hardness values measured at an exterior area and an interior area of the workpiece.

The evenly improved hardness can lead to improvement in mechanical properties such as strength and wear resistance of a workpiece. Consequently, since the severe plastic deformation process of the embodiment of the present invention can remarkably improve mechanical properties of a workpiece by means of a simple process while maintaining the shape of the conic metal pipe workpiece, the present invention can be appropriately applied to products such as bullets and missiles which require strong mechanical properties.

The invention claimed is:

1. A method of performing a torsional plastic forming process to a conic metal pipe, comprising:

mounting a punch having a configuration corresponding to an interior configuration of the conic metal pipe in the conic metal pipe;

mounting a metal die having a configuration corresponding to an exterior configuration of the conic metal pipe on the conic metal pipe; and concurrently applying compressive and twisting forces to the conic metal pipe through the punch and the metal die to cause shear deformation of the conic metal pipe, thus enabling a fine microstructure of the conic metal pipe to have ultrafine crystal grains or nanocrystalline grains, wherein a radius of curvature of a tip of the punch is larger than a tip of the conic metal pipe.

2. The method according to claim 1, wherein the shear deformation is obtained by pressing the punch against the metal die and rotating the punch.

3. The method according to claim 2, wherein an amount of the shear deformation is controlled by adjustment of a compressive force and a number of revolutions of the punch.

4. The method according to claim 3, wherein a higher compressive force is applied to a central area of the conic metal pipe so as to cause the fine microstructure of the central area to have ultrafine crystal grains or nanocrystalline grains.

5. The method according to claim 3, wherein a shape of the conic metal pipe before the torsional plastic forming process is equal to a shape of a conic metal pipe after the torsional plastic forming process, other than the of thickness.

6. The method according to claim 3, wherein the metal die includes a heating element to control a process temperature.

7. The method according to claim 3, wherein the punch includes a heating element to control a process temperature.

8. The method according to claim 2, wherein a higher compressive force is applied to a central area of the conic metal pipe so as to cause the fine microstructure of the central area to have ultrafine crystal grains or nanocrystalline grains.

9. The method according to claim 2, wherein a shape of the conic metal pipe before the torsional plastic forming process is equal to a shape of a conic metal pipe after the torsional plastic forming process, other than the of thickness.

10. The method according to claim 2, wherein the metal die includes a heating element to control a process temperature.

11. The method according to claim 2, wherein the punch includes a heating element to control a process temperature.

12. The method according to claim 1, wherein a higher compressive force is applied to a central area of the conic metal pipe so as to cause the fine microstructure of the central area to have ultrafine crystal grains or nanocrystalline grains.

13. The method according to claim 1, wherein a shape of the conic meal pipe before the torsional plastic forming process is equal to a shape of a conic metal pipe after the torsional plastic forming process, other than the of thickness.

14. The method according to claim 1, wherein the metal die includes a heating element to control a process temperature.

15. The method according to claim 1, wherein the punch includes a heating element to control a process temperature.

16. The method according to claim 1, wherein the metal die is rotatable alone or together with the punch.

17. The method according to claim 1, wherein, a curvature of the tip of the metal die is equal to a curvature of the tip of the punch, and a vertex portion of the conic metal pipe is closed.

* * * * *